US005938369A

United States Patent [19]

Peters

[11] Patent Number: 5,938,369

[45] Date of Patent: Aug. 17, 1999

[54] SUPPORT FOR CATHEDRAL CEILING BEAMS

[76] Inventor: Donald E. Peters, 1 Edgewater Plz., Staten Island, N.Y. 10305

[21] Appl. No.: 07/792,612

[22] Filed: Nov. 15, 1991

[51] Int. Cl.[6] ..... B25G 3/36

[52] U.S. Cl. ..... 403/400; 403/394; 403/232.1; 52/92; 16/389

[58] Field of Search ..... 403/394, 400, 403/232.1, 403, 98, 4; 52/92, 639; 16/389, 390, 392

[56] References Cited

U.S. PATENT DOCUMENTS 2,413,362 12/1946 Maxwell et al. ..... 403/403
4,311,407 1/1982 Doyle ..... 403/400 X

FOREIGN PATENT DOCUMENTS 2222221 2/1990 United Kingdom ..... 403/232.1

*Primary Examiner*—Andrew V. Kundrat
*Attorney, Agent, or Firm*—William T. Hough, Esq.

[57] ABSTRACT

A cathedral ceiling beam support combination of identical first and second elongated support elements each extending along longitudinal axes thereof, each having opposite first and second ends and having intermediate structure extending along an imaginary upright plane between and interconnecting the first and second ends, pivot structure and thereof pivotably connecting the first and second support elements through the intermediate elongated structure, each of the first and second support elements further including a laterally-extending flange having a downwardly-facing support surface adapted to press against a surface of a support beam, and beam-attachment structure and mechanism thereof on the laterally-positioned flange for securing the laterally-positioned flange to a support beam, the laterally-extending flange and the downwardly-facing support surface each extending at an angle of about 90 degrees relative to the upright plane, the beam-attachment structure including a plurality of through-space apertures through the laterally-positioned flange of a size receivable of pin means for anchoring and securing the laterally-extending flange to a beam, the pivot structure including a through-space hole through the intermediate elongated structure and a pivot pin-structure mounted through the through-space hole, and a bracing structure mounted on each of and extending between the intermediate elongated structure and the laterally-positioned flange, the elongated support element and the intermediate structure thereof and the laterally-extending flange having and sharing a continuous edge extending between the first and second ends along the longitudinal axis, and the laterally-extending flange extending between the first and second ends, and the cathedral ceiling having its beams supported at the upper apex thereof by the beam support combination.

13 Claims, 5 Drawing Sheets

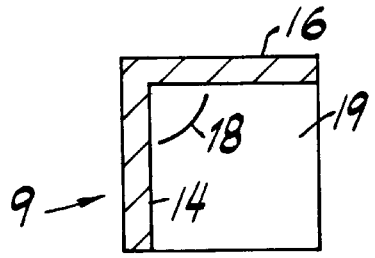
FIG. 2
FIG. 3
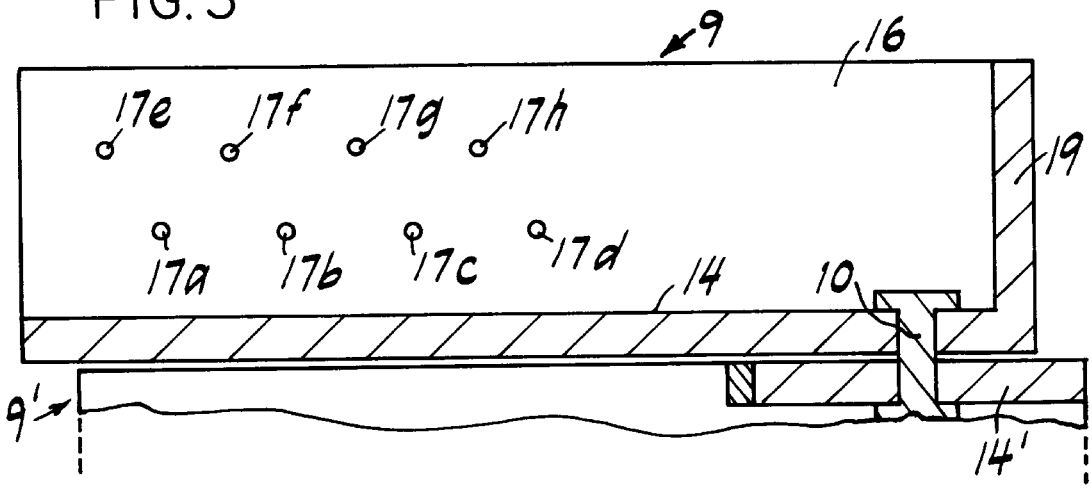
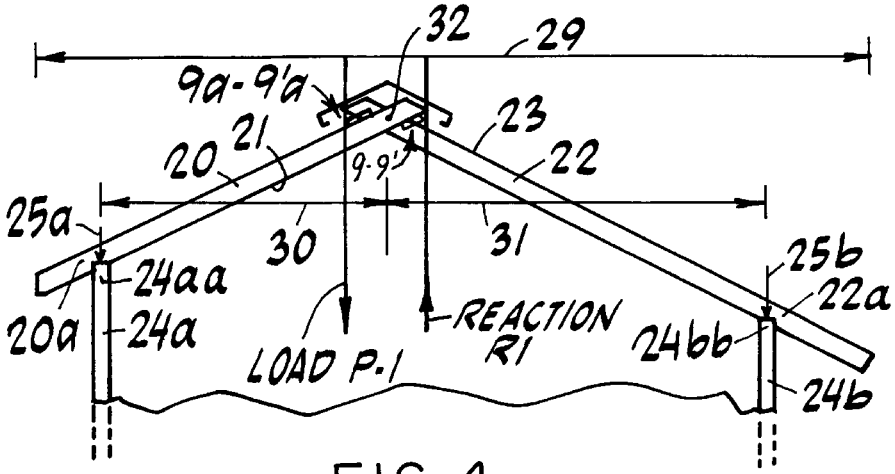
FIG. 4

SUPPORT FOR CATHEDRAL CEILING BEAMS

SPECIFICATION

This invention is directed to a novel beams-bracing structure utilizable in a novel construction of a cathedral ceiling.

PRIOR ART

While no relevant prior art was located in a conducted novelty patentability search, patents of mere interest include: U.S. Pat. No. 3,969,869 of Partridge granted Jul. 20, 1976 directed to triangular roof-supporting trusses; and U.S. Pat. No. 4,833,859 of Wolf granted May 30, 1989 directed to a composite beams joined by nailed plates along the longitudinal axes of the composite beams; U.S. Pat. No. 4,773,192 of Andrews granted Sep. 27, 1988 directed to a paralleled grooved metal sheet bracing bracket grooved from edge to edge of opposite edges and having a central part-circular structure; U.S. Pat. No. 4,503,651 of Pugh granted Mar. 12, 1985 directed to a ridge latch plate and cooperating latch pin joining-together two beams having their respective upper ends in end-to-end abutment; U.S. Pat. No. 4,335,555 of Southerland granted Jun. 22, 1982 directed to a substantially tubular rafter assembly having tube-end female receptacles for insertion of opposing rafter ends. U.S. Pat. No. 3,786,612 of Baker granted Jan. 22, 1974 directed to coaxial parallel tubular connectors having female receptacles and angular coaxial male members having opposite ends thereof insertably mateable within the female receptacles.

BACKGROUND TO THE INVENTION

None of the above-noted prior art has any relevance to the present invention directed to support problems faced in architectual efforts to achieve most expedient and less cumbersome effective support beams arrangement for structures conventionally known as cathedral ceilings such as prior art structures of prior art FIGS. 9 and 10, structure of FIG. 9 showing horizontal cross-support collars A and the like for beams B and C additionally having an apex-beam D, and structure II having corresponding differently arranged beams A', A", B', C' and D' resembling above-noted U.S. Pat. No. 3,969,869 structures illustrated threin. The weight of the beams and of the ceiling and/or roof associated therewith is excessive and heretofore has required elaborate structure, heretofore a principle approach having been to mere attempt to achieve the "effect" of a cathedral ceiling while in fact merely hiding massive support structure above a cathedral-appearing ceiling. Problems faced have dealt not only with the desired achieving of the appearance of a cathedral ceiling, but the task and problems associated with achieving factually such structure devoid of excessive hidden structure while concurrently having the need to achieve a great and sufficient safety factor in support strength against the massive weight of the overall structure and roof.

THE OBJECTS

Accordingly, objects of the invention include the overcoming of problems and difficulties and disadvantages of the type discussed above, together with the achieving of a new and more efficient and less cumbersome beams-support structure and mechanism thereof, in the achieving of a cathederal ceiling appearance.

More particularly an object is to obtain a novel beams-support structure affording maximum support with a minimum of visually discernible support, especially adaptable to and for a cathederal ceiling appearance.

Another object is to obtain an improved strength-inagnitude of beans support at upper apexes thereof, especially in the achieving of a cathederal ceilings appearance.

Another object is to obtain a novel structure adaptable to joining upper apex portions of roof and/or ceiling support beams coming together at variable angles of incidence relative to one-another, especially in the achieving of a cathederal ceilings appearance and support.

Other objects become apparent from the preceding and following disclosure.

BROAD DESCRIPTION

Broadly the invention may be defined as a cathedral ceiling beam support device comprising a combination, and a ceiling or roof structure embodying the same. The device is a combination of first and second elongated support elements and a pivot stricture and mechanism thereof and beam attachment structure and mechanism thereof. The first and second elongated support elements each and both extend along a longitudinal axes thereof. Each of the elongated support elements has opposite first and second ends and has intermediate structure extending along an imaginary upright plane between and interconnecting the first and second ends. Pivot structure and mechanism thereof pivotably connect the first and second support elements through the intermediate elongated structure. Each of the first anal second support elements further include at-least one laterally-extending flange having a downwardly-facing support surface adapted to press against a flattened surface of a support beam. And there is beam-attachment structure and mechanism thereof on the laterally-extending flange adapted to secure the laterally-extending flange to a support beam.

In a first preferred embodiment as an improvement on the above-described broad invention, the laterally-extending flange and the downwardly-facing support surface each extend at an angle of about 90 degrees relative to the upright plane.

In a second preferred embodiment as an improvement on the first preferred embodiment, the beam-attachment structure and mechanism thereof comprise at-least one through-space apertures through the laterally-extending flange of a size receivable of pin structure and mechanism thereof for anchoring and securing the laterally-extending flange to a beam.

In a third preferred embodiment as an improvement on the second preferred embodiment, the beam-attachment structure and mechanism thereof comprise a plurality of the through-space apertures.

In a Fourth preferred embodiment as all improvement on the third preferred embodiment, the pivot structure and mechanism thereof comprise a through-space hole through the intermediate elongated structure and a pivot pin-structure mounted through the through-space hole.

In a fifth preferred embodiment as an improvement on the fourth preferred embodiment, there is included a bracing structure mounted on each of and extending between the intermediate elongated structure and the laterally-extending flange.

In a sixth preferred embodiment, as an improvement on the fifth preferred embodiment, the elongated support element and the intermediate structure thereof and the laterally-extending flange have and share a continuous edge extending between the first and second ends along the longitudinal axis, the laterally-extending flange extending between the first and second ends.

In a seventh preferred embodiment, as an improvenent on the broad invention as above defined, the beam-attachment structure and mechanism thereof comprise at-least one through-space apertures through the laterally-extending flange of a size receivable of pin structure and mechanism thereof for anchoring and securing the laterally-extending flange to a beam.

In an eighth preferred embodiment as an improvement on the first preferred embodiment, the beam-attachment structure and mechanism thereof comprises a plurality of the through-space apertures.

In a ninth preferred embodiment as an improvement on the second preferred embodiment, tile pivot structure and mechanism thereof comprises a through-space hole through the intermediate elongated structure and a pivot pin-structure mounted through the through-space hole.

In a tenth preferred embodiment as an improvement on the third preferred embodiment, there is included a bracing structure mounted on each of and extending between the intermediate elongated structure and the laterally-extending flange.

In an eleventh preferred embodiment as an improvement on the fourth preferred embodiment, the elongated support element and the intermediate structure thereof and the laterally-extending flange have and share a continuous edge extending between the first and second ends along the longitudinal axis, the laterally-extending flange extending between the first and second ends.

In a twelfth preferred embodiment as an improvement on the fifth preferred embodiment, there is provided a cathedral ceiling having ceiling support beams joined and supported at substantially an upper apex thereof by a cathedral ceiling beam support combination of the above-described broad invention.

In a thirteenth preferred embodiment as an improvement on the sixth preferred embodiment, there is provided a cathedral ceiling having ceiling support beams joined and supported at substantially an upper apex thereof by a cathedral ceiling beam support combination of the above-described sixth preferred embodiment.

The invention may be better understood by making reference to the following Figures.

THE FIGURES

FIG. 1 diagrammatically illustrates the novel cathedral ceiling beam support device of this invention, in a side view thereof with partial cut-away illustrating plate apertures, being shown positioned as it would be fitted on and supporting apex upper ends of meeting ceiling or roof beams shown in phantom.

FIG. 2 diagrammatically illustrates a cross-sectional view as taken along lines 2—2 of the FIG. 1 embodiment.

FIG. 3 diagrammatically illustrates a cross-sectional view as taken along lines 3—3 of the FIG. 1 embodiment.

FIG. 4 diagrammatically illustrates an in-part view of the frame and body of a typical house structure having the cathedral beams arrangement supported by two of the novel combinations illustrated in FIGS. 1, 2 and 3.

FIG. 5 diagrammatically illustrates an in-part side view of a typical cathedral beams arrangement supported by two of the novel combinations illustrated in FIGS. 1, 2 and 3.

FIG. 6 diagrammatically illustrates an in-part top and side perspective view of the typical cathedral beams arrangement and supporting novel combinations of FIG. 5.

FIG. 7 diagrammatically illustrates a cathedral beams arrangement embodying bent-beam segments supported by two of the novel combinations illustrated in FIGS. 1, 2 and 3.

FIG. 8 illustrates a side view of cathedral ceiling beams utilizing another embodiment of the present invention.

FIGS. 9 and 10 diagrammatically disclose in-part views of prior art discussed in the preceding background discussion.

DETAILED DESCRIPTION

The invention as illustrated in the foregoing FIGS. 1 through 8 each and all illustrate the same novel cathedral ceiling beam support device and combination of the present invention. Additionally, however the FIGS. 4 through 8 illustrates the combinations inclusive of beams supported by the support device of FIGS. 1 through 3. Accordingly, the same support device is illustrated in all Figures. For common elements in the various Figures, related indicia are utilized. Once described for one figure and/or embodiment, description of the same element is not repeated except in certain instances for purposes of improving understanding and clarity.

Figure 9:
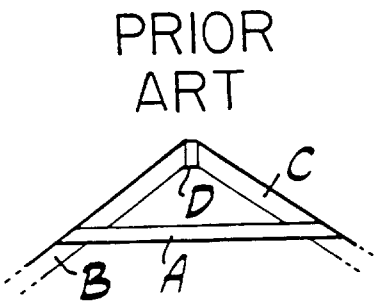
Figure 10:
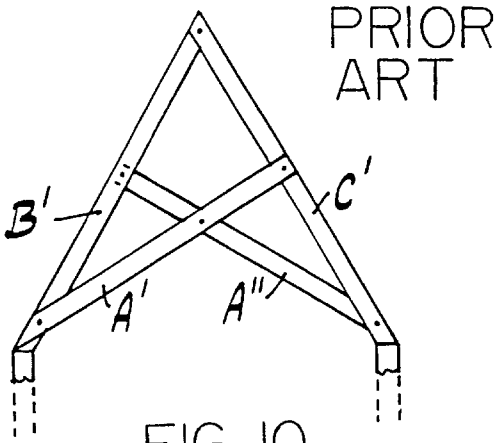
Figure 1:
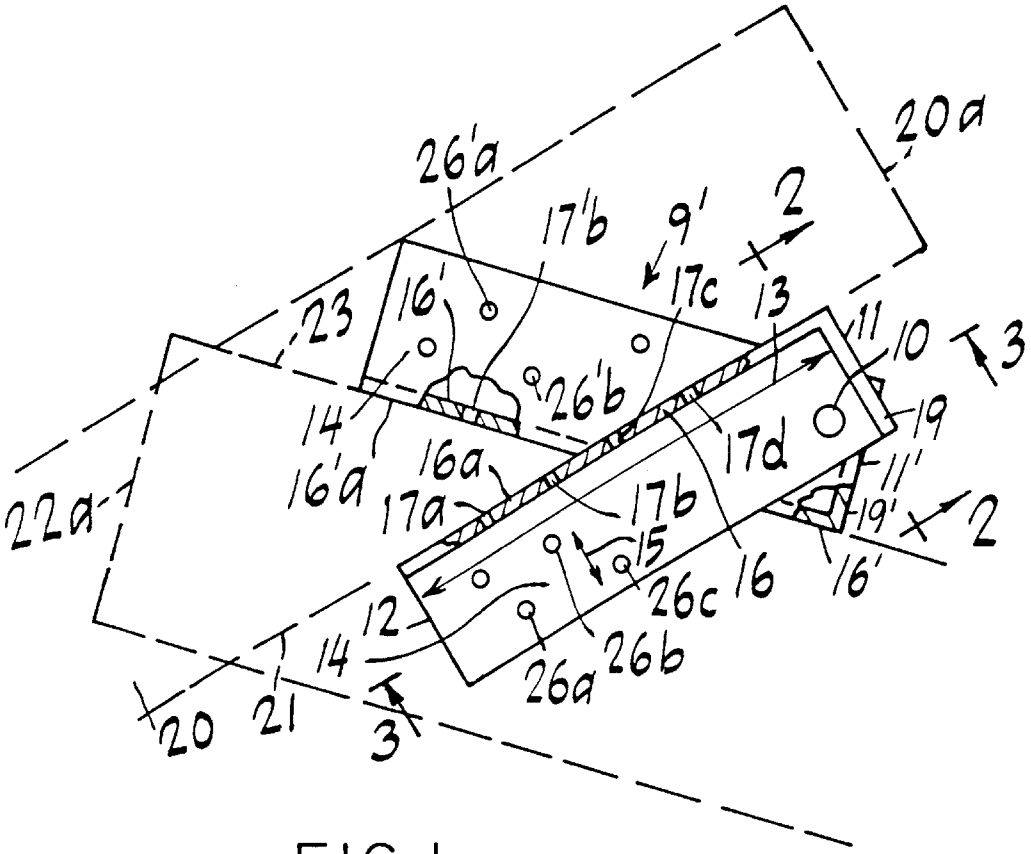

FIG. 1 illustrates the greater combination of back-to-back identical but oppositely-directed first and second elongated support elements 9 and 9', the pivot structure 10 and mechanism thereof, the laterally-extending flanges 16 and 16', typical beam-attachment structures apertures shaped and structured to receive attaching pin elements—namely pins and/or nails and/or bolts, as typical apertures 17*a* through 17*c*, 17'*b*, etc. and 26*a* through 26*c*, etc. and 26'*a*, etc., and 26'*a*, etc. for attachment to the respective beams (shown in phantom) 20 and 22 and their respective attachment support surfaces 21 and 23 respectively—attachment thereto preventing sliding of the element support surfaces 16*a* and 16'*a* respectively from sliding downwardly along the surfaces 21 and 23 respectively.

Also shown in FIG. 1 are the opposite ends 11 and 12 of the first elongated support element 9 and the end 11' of elongated support element 9', with the intermediate elongated structures 14 and 14', the intermediate elongated structure 14 extending along an elongated axis 13 between opposite ends 11 and 12 and the intermediate elongated structure 14 being uprightly positioned in an upright plane extending along upright linear line 15. At the ends 11 and 11' respectively, there is a bracing structure 19 of the first elongated support element 9, and bracing structure 19' of the second elongated support element 9'. The bracing element 19 is continuous with the end 11 of the intermediate elongated structure 14 and with the flange 16. The flanges 16 and 16' have support surface 16*a* for the first elongated support element 9 and support surface 16'*a* for the second elongated support element 9'.

FIG. 2, as above-noted, diagrammatically illustrates a view of the first support element 9 as taken along line 2—2 of FIG. 1, showing previously described features 14, 16 and 19, but additionally illustrating the typical angle 18 of about 90 degrees in this representative illustration.

FIG. 3, likewise as above-noted, diagrammatically illustrates a view of the second support element 9' as taken along line 3—3 of FIG. 2, showing features and/or elements all previously described, but better illustrating the position and arrangement of the pin bolt 10 thereof and it pivot relationship and binding-together of the first and second support elements 9 and 9'.

FIG. 4 diagrammatically illustrates a combination and/or composite of the beam support devices previously above-described in combination with the beams 20 and 22, at their respective lower outer ends 20*a* and 22*a* being supported by upright walls or upright beams 24*a* and 24*b* respectively. The downward load expressed in pounds on the upper ends 24*aa* and 24*bb* are represented by the load or weight stress-arrows 25*a* and 25*b*, respectively. Other elements have been previously described, apart from also a second set of the device being illustrated as beam support device having its first and second elongated support elements 9*a* and 9'*a* in combination, pivotally connected in the same manner as first and second elongated support elements 9 and 9'.

Figure 5:
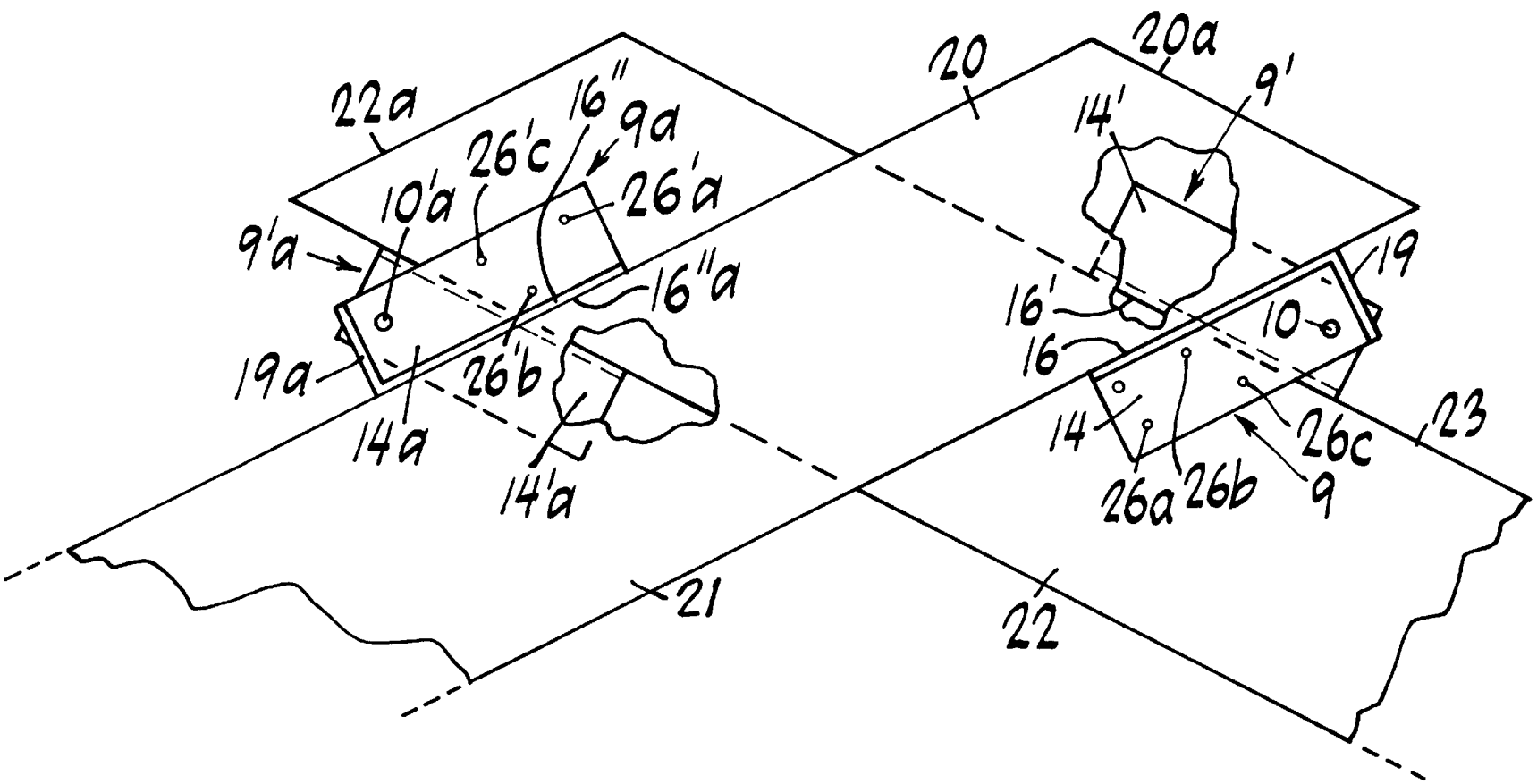

In enlarged view, and in greater detail, FIG. 5 illustrates in side in-part and partial cut-away view, the same FIG. 4 features for the two pairs of first and second elongated support elements 9–9' and 9*a*–9'*a* respectively in combination with the beams 20 and 22. In the mounted states of the elongated support elements 9 and 9*a* respectively, nail-heads 26*a*–26*c* and 26'*a*–26'*b* are illustrated, nails having been driven into the beams 22 in each instance.

Figure 6:
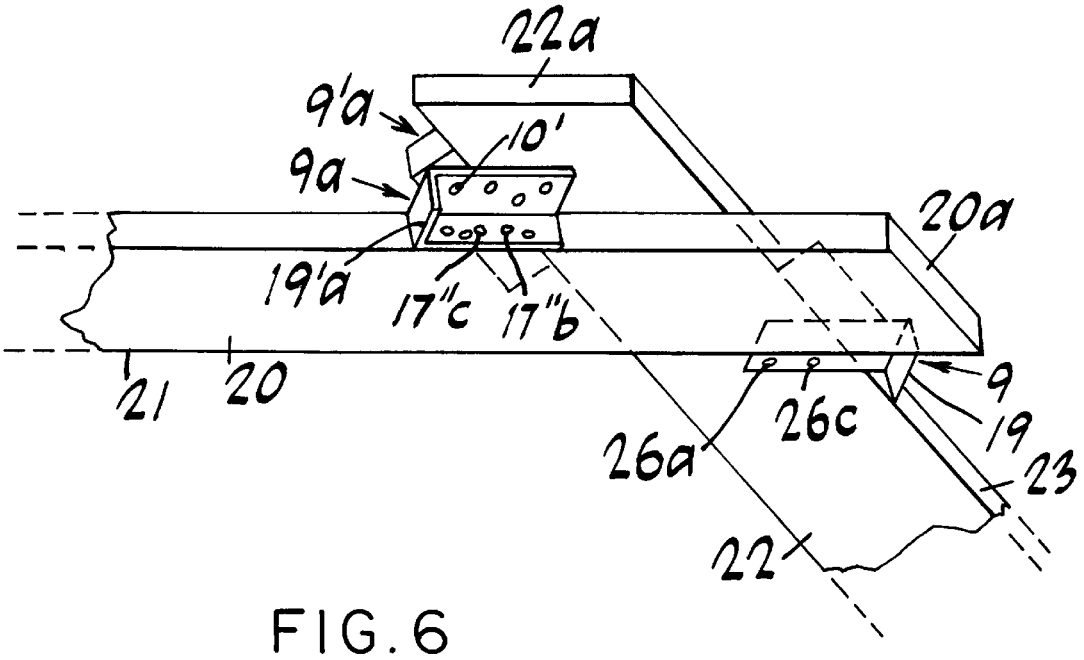

FIG. 6 illustrates in perspective front and top view the same features shown in FIG. 5, all illustrated elements having been previously described, apart from additionally visible nail-heads 17"*b* and 17"*c*, and the like, this perspective enhancing understanding of the relationships and positioning relative to the beams 20 and 22.

Figure 7:
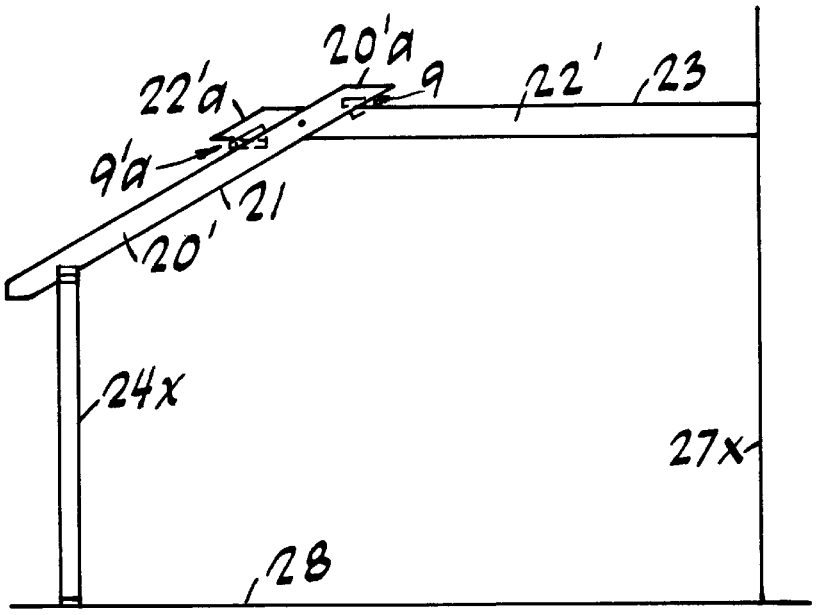
Figure 8:
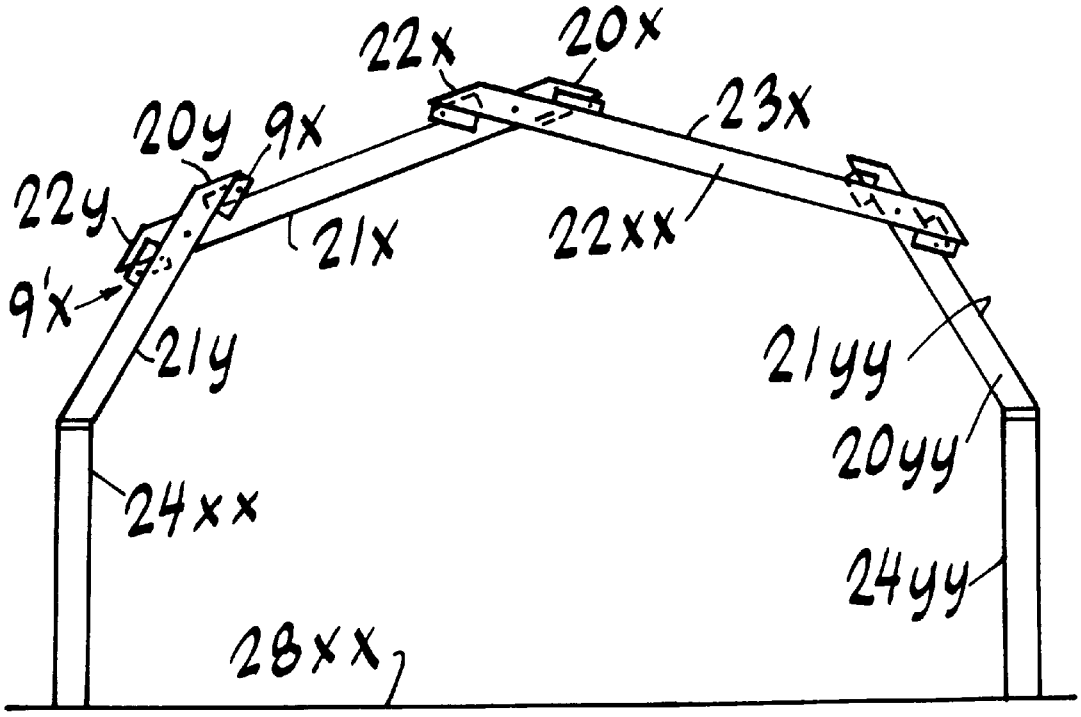

FIGS. 7 and 8 each illustrate additional combination or composite combinations and positioning of beams of such combinations or composites, for beams and ceiling beam devices and first and second elongated support elements and other elements thereof previously described, both figures showing a side view together with upright columns or beams as in FIG. 4.

With further reference to the embodiment of FIG. 4 as typically illustrative for the load or weight factors 25*a* and 25*b* respectively at beam locations 20*a* and 22*a* respectively the following data is illustrative. The design roof loading for a completed housing dwelling inclusive of: ⅝ inch plywood—177; 2×8 16 inch O.C.—1.99 pounds; ½ inch plaster board/2.00 pounds; Asph. shingles at 2.75 pounds; and insulation 0.40; totaling 8.91 pounds, plus live load of 20 pounds, totaling 28.91 pounds. Total load per 16 inches spacing is 28.91 pounds multiplied by 1.33, equaling 38.54 pounds, requiring use of 39 pounds per lineal foot of roof beam.

With regard to reactions, the FIG. 4 beams 20 and 22 in combination with beam support devices 9*a* and 9'*a* depicted, act as a single bent beam simply supported. All elements are in equilibrium. Solving for beam support loads where in a horizontal plane the distance between the left end of beam 20 and the right end of beam 22 depicted by indicia 29 is 19 feet, and where the horizontal depicting distance between the peak 32 and the load points 24*aa* and 24*bb*, are 6.5 feet for indicia 30 and 9.5 feet for indicia 31, total loads for load line 25*a* is 378.4 pounds and for load line 25*b* is 362.6 pounds, using reaction force 25*a* and horizontal distance from 24*a* to pin 10 or 9*a*–9'*a* support devices for indicia 33 and the distance from pin 10 of left 9*a*–9'*a* support device to pin 10 of righ 9–9'*a* support device for indicia 34. Solving for beam 20, for load P-1 and for reaction load R-2, P-1 is 591.3 pounds and R-1 is 531.5 pounds, when employing the beam support devices herein described above of the present invention.

In comparable computations for beam 22 for P-2 and for R-2, P-2 is 531 pounds and R-2 is 590.8 pounds, when employing the beam support devices herein described above of the present invention.

It is within the scope of the invention to make such variations and modifications and substitution of equivalents as would be apparent to a person of ordinary skill in this particular art.

I claim:

1. A cathedral ceiling beam support device comprising in combination: first and second elongated support elements each extending along longitudinal axes thereof, each of said first and second elongated support elements having opposite first and second ends and having intermediate structure extending along an imaginary upright plane between and interconnecting the first and second ends, pivot means pivotably connecting the first and second support elements at said intermediate elongated structure, and each of said first and second elongated support elements including at least one laterally-extending flange having a downwardly-facing support face adapted to press against a surface of a support beam, and beam-attachment means on each said laterally-positioned flange, for securing one of said laterally-extending flanges to one support beam and for securing a remaining different one of said laterally-extending flanges to a different support beam.

2. The cathedral ceiling beam support device of claim 1, in which said laterally-extending flange and said downwardly-facing support surface each extend at an angle of about 90 degrees relative to said upright plane.

3. The cathedral ceiling beam support device of claim 2, in which said beam-attachment means comprises at-least one through-space apertures through said laterally-positioned flange of a size receivable of pin means for anchoring and securing the lateraly-extending flange to a beam.

4. The cathedral ceiling beam support device of claim 3, in which said beam-attachment means comprises a plurality of said through-space apertures.

5. The cathedral ceiling bean support device of claim 4, in which said pivot means comprises a through-space hole through said intermediate elongated structure and a pivot pin-structure mounted through said through-space hole.

6. The cathedral ceiling beam support device of claim 5, in which each of said first and second elongated support support elements includes a bracing structure mounted on each of and extending between said intermediate elongated structure and said laterally-extending flange thereof.

7. The cathedral ceiling beam support device of claim 6, in which for each of said first and second elongated support elements, said elongated support element and the intermediate structure thereof and said laterally-extending flange thereof have and share a continuous edge extending between said first and second ends along said longitudinal axis thereof, said laterally-extending flange extending between said first and second ends thereof.

8. The cathedral ceiling beam support device of claim 1, in which said beam-attachment means comprises at-least one through-space apertures through said laterally-extending flange of a size receivable of pin means for anchoring and securing the lateraly-extending flange to a beam.

9. The cathedral ceiling beam support device of claim 1, in which said beam-attachment means comprises a plurality of said through-space apertures.

10. The cathedral ceiling beam support device of claim 1, in which said pivot means comprises a through-space hole through said intermediate elongated structure and a pivot pin-structure mounted through said through-space hole.

11. The cathedral ceiling beam support device of claim 1, in which each of said first and second elongated support support elements includes a bracing structure mounted on each of and extending between said intermediate elongated structure and said laterally-extending flange thereof.

12. The cathedral ceiling beam support device of claim 1, in which said elongated support element and the intermediate structure thereof and said laterally-extending flange have and share a continuous edge extending between said first and second ends along said longitudinal axis, said laterally-extending flange extending between said first and second ends.

13. A cathederal ceiling beam support device comprising: an elongated support element extending along a longitudinal axis thereof, having opposite first and second ends and having intermediate structure extending along an imaginary upright plane between and interconnecting the first and second ends, pivot means pivotably connecting the elongated support element at said intermediate elongated structure to another one of said elongated support element characterized as a mirror image of said support element, said elongated support element further including at-least onelaterally-extending flange having a downwardly-facing support surface adapted to press against a surface of a support beam, and beam-attachment means on said laterally-positioned flange for securing said laterally-extending flange to a support beam.

* * * * *